US005142269A

United States Patent [19]

Mueller

[11] Patent Number: 5,142,269

[45] Date of Patent: Aug. 25, 1992

[54] ELECTRONIC COMPONENT THEFT SENSOR AND SECURITY SYSTEM

[75] Inventor: Joel M. Mueller, Omaha, Nebr.

[73] Assignee: Charles T. Rush, Omaha, Nebr.

[21] Appl. No.: 677,986

[22] Filed: Apr. 1, 1991

[51] Int. Cl.[5] ..... G08B 13/14

[52] U.S. Cl. ..... 340/568; 340/687; 439/917

[58] Field of Search ..... 340/568, 687, 310 CP, 340/650, 654, 661, 516; 439/189, 917, 489-490; 250/227.11; 361/170; 324/158 F

[56] References Cited

U.S. PATENT DOCUMENTS

| | | | |
|---|---|---|---|
| 3,972,039 | 7/1976 | Marshall | 340/508 |
| 4,011,555 | 3/1977 | Pearce | 340/568 |
| 4,151,521 | 4/1979 | Wirth, Jr. | 340/568 |
| 4,222,043 | 9/1980 | Malavasi | 340/568 |
| 4,284,983 | 8/1981 | Lent | 340/568 |
| 4,300,130 | 11/1981 | Fotheringham et al. | 340/568 |
| 4,494,114 | 1/1985 | Kaish | 340/825.31 |
| 4,563,673 | 1/1986 | Fechner | 340/568 |
| 4,639,719 | 1/1987 | Pappano et al. | 340/655 X |
| 4,654,640 | 3/1987 | Carll et al. | 340/568 |
| 4,686,514 | 8/1987 | Liptak, Jr. et al. | 340/571 |
| 4,849,743 | 7/1989 | Ohno | 340/687 |
| 4,902,968 | 2/1990 | Sugimoto | 324/158 F |
| 4,935,725 | 6/1990 | Turnau | 340/568 |

*Primary Examiner*—Jin F. Ng
*Assistant Examiner*—Thomas J. Mullen, Jr.
*Attorney, Agent, or Firm*—John A. Beehner

[57] ABSTRACT

An anti-theft system for electronic component(s) with conventional data port connectors. The invention includes a single sensor or a plurality of interconnected sensors. Each sensor includes a housing and a pair of interconnected conventional data connectors. Switching means is associated with each conventional data connector so that an open alarm circuit connected to the switching means is opened when the data connector is plugged into a compatible data connector and closed when the data connector is unplugged from a compatible data connector. Likewise, closed alarm circuitry is also connected to the switching means which is closed when the data connector is plugged into a compatible data connector and opened when the connector is unplugged and whereby if the closed alarm circuitry is cut an alarm will sound.

21 Claims, 7 Drawing Sheets

ELECTRONIC COMPONENT THEFT SENSOR AND SECURITY SYSTEM

BACKGROUND OF THE INVENTION

1. Technical Field

The present invention is directed to alarms and more particularly to security systems adapted to prevent the theft of electronic equipment.

2. Description of the Prior Art

Through integration and semiconductor technologies computer manufacturers have been extremely successful in reducing the size of their products. Computers with fewer features than todays personal computer once filled large rooms. Today a computer with more capability can easily fit within a conventional briefcase.

The main components of a personal computer are housed within a single case. This case usually contains the central processor, random access memory, read only memory, diskette drive or drives, hard disk or winchester drive, controller cards, and expansion slots. Several connectors are usually provided at the rear of the case that allow peripheral input and output devices to be connected for reading, writing or otherwise displaying information. For example, a keyboard, monitor, printer, modem, mouse, plotter, or digitizer may be connected (via a cable) to the connectors located on the rear of the case.

In addition to conventional personal computers many manufacturers market full featured laptop and notebook sized computers. These computers are small, expensive, and in high demand.

Computer stores generally display personal computers on desk high counters. For demonstration purposes these computers are usually connected to a printer or mouse, or other type of output or input device. In this way shoppers may examine several different models of computer, monitor, and printer, before selecting a suitable system for their home or office.

Thefts of computer related equipment has increased as the size of computers and peripheral equipment has decreased. This is especially true of smaller peripherals, and laptop and notebook sized computers. Thieves poising as shoppers walk into busy computer stores, disconnect a peripheral or computer from its associated cables, slip the device under their coat, and then walk from the store.

Likewise, hotels and motels and the like frequently provide each room with a television receiver. Many such establishments also provide video and stereo equipment.

In order to prevent theft these television receivers are usually securely fastened to a table which may in turn be bolted to the room floor. This added anti-theft hardware significantly adds to the establishments cost of providing each room, makes guest viewing difficult, and increases the amount of time necessary to effectuate repairs.

Likewise, stereophonic and high fidelity equipment dealers are also plagued by thefts from their stores. Amplifiers, receivers, cassette decks, compact disk players, phonographs, equalizers, and speakers are often interconnected for customer sound tests. Thieves poising as customers often remove car stereo and home video and stereo equipment from these displays.

Several prior art devices are available for protecting electronic equipment from theft. For example, Turnau, U.S. Pat. No. 4,935,725, discloses a merchandise security system which is activated when the electrical plug of an electronic device is removed from a special electrical outlet strip; Liptak, et al., U.S. Pat. No. 4,686,514, discloses a computer alarm having a motion sensing unit; Fechner, U.S. Pat. No. 4,563,673, discloses a video cassette player/recorder anti-theft device which utilizes a movement-sensitive switch; Kaish, U.S. Pat. No. 4,494,114, discloses a security arrangement for rendering microprocessor controlled electronic equipment inoperative; Fotheringham, et al., U.S. Pat. No. 4,300,130 discloses a stereo component alarm circuit which requires the use of sensing units that must be glued to the device to be protected; Lent, U.S. Pat. No. 4,284,983, discloses an alarm for installation in electrical appliances activated when the appliance is moved or unplugged from its power supply; Malavasi, U.S. Pat. No. 4,222,043, discloses a portable self-contained security system which utilizes a closed circuit that interrupts the protected equipment ground; Wirth, Jr., U.S. Pat. No. 4,151,521, discloses a power tool theft alarm which utilizes a change in load impedance to activate an alarm; Pearce, U.S. Pat. No. 4,011,555, discloses a radio and television alarm system activated when the radio or television is unplugged from its power supply; and Marshall, U.S. Pat. No. 3,972,039, discloses an article removal alarm utilizing special three-contact receptacles tied around the protected article.

While all of the before described devices are suitable for their intended purpose they are not suited to accomplish the objects of the present invention.

3. Objects of the Invention

Therefore, it is a principal object of the present invention to provide an improved electronic component security sensor and system.

Another object of the present invention is to provide an improved electronic component security sensor and system for use in electronic components having standardized data connection ports such as computer, video, and stereophonic equipment.

Another object of the present invention is to provide an improved electronic component security sensor and system which provides both open and closed alarm circuitry technology.

Another object of the present invention is to provide an improved electronic component security sensor and system which is adapted to prevent the theft of a number and variety of electronic devices.

Another object of the present invention is to provide an improved electronic component security system which may be configured to tell which sensor in a series of sensors has been activated.

Another object of the present invention is to provide an improved electronic component sensor and security system which may determine whether an electronic component has been turned on if off and off if on.

Another object of the present invention is to provide an improved electronic component sensor and security system that does not interrupt or interfere with the operation of the sensed device.

Another object of the present invention is to provide an improved electronic component sensor and security system which may be connected in series with other sensors and security systems.

Another object of the present invention is to provide an improved electronic component sensor and security system which may be locally disabled.

Another object of the present invention is to provide an improved electronic component sensor and security system which is economical to manufacture and durable in use.

Another object of the present invention is to provide a computer component security system which is efficient in operation and refined in appearance.

Another object of the present invention is to provide a computer component security system which is easy to install, simple in construction, and trouble free.

Finally, another object of the present invention is to provide an electronic component sensor and security system which is transparent to the operation of an electronic component. These and other objects will be apparent to those skilled in the art.

SUMMARY OF THE INVENTION

The present invention is an improved electronic component sensor and security system. The invention provides an anti-theft sensor fashioned as a conventional data connector adapter such as a DB-9, Mini 8, Apple Talk Connector, Mini 3, RJ-11, RJ-45, High-Density 15 Pin Connector, D-Sub 9-Pin Connector, IBM System 3270 Coax, BNC for RG62A, BNC for RG59B, 25- Pin, 36-Line Centronics, 37-Pin, 50-Pin, 62-Pin, IEEE, IBM Twinaxial, Wang Dbl. Coax, Dataproducts 50-Pin, Centronics 50-Pin, 8-Pin DIN, RS-449, RS-422, RS-423, DIN or other data connectors such as stereo and video RCA Jacks.

The invention includes at least two conventional connectors at least one of which is adapted to be removably connected to the data port of an electronic device. The connectors are preferably mounted on a housing which may or may not also house alarm circuitry and a power supply.

The alarm preferably includes: (1) open and closed alarm circuitry, (2) signal means, and (3) means for connecting the open and closed alarm circuitry to an electric power source. Also housed within the housing, and in association with each conventional connector, is an alarm switching means adapted to close the closed alarm circuitry when its associated conventional connector is removably connected to the data port of an electronic device and to open the closed alarm circuitry when its associated conventional connector is disconnected from the data port of an electronic device.

Also provided are means connecting the provided alarm switching means to the alarm open and closed circuitry so that the closed alarm circuitry is closed so long as the connection means is unbroken and opened if the connection means is broken whereby the signal means of the alarm announces the closing of the open alarm circuitry and the opening of the closed alarm circuitry.

BRIEF DESCRIPTION OF THE DRAWINGS

Other objects and advantages of the invention will become apparent upon reading the following detailed description and upon reference to the drawings, in which:

FIG. 8 is an electrical schematic for alarm circuitry capable of detecting if an electronic component which was on has been switched off and if off whether it has been switched on;

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DESCRIPTION OF THE PREFERRED EMBODIMENT

Almost all electronic devices include some form of data connector. For example, personal computers customarily have both a serial communication port (RS-232 connector) and a parallel communication port (Centronics connector). Peripheral devices such as printers, modems, and the like may be connected to the computer via cables. Personal computers also have keyboard and video data port connectors for attaching a keyboard and monitor to the computer.

Personal computers in offices are often interconnected in local area networks (LAN). Local area networks allow files and data to be shared between the interconnected computers and are established in part by interconnecting each computer to a server computer via coaxial cable and connectors.

Figure 1:
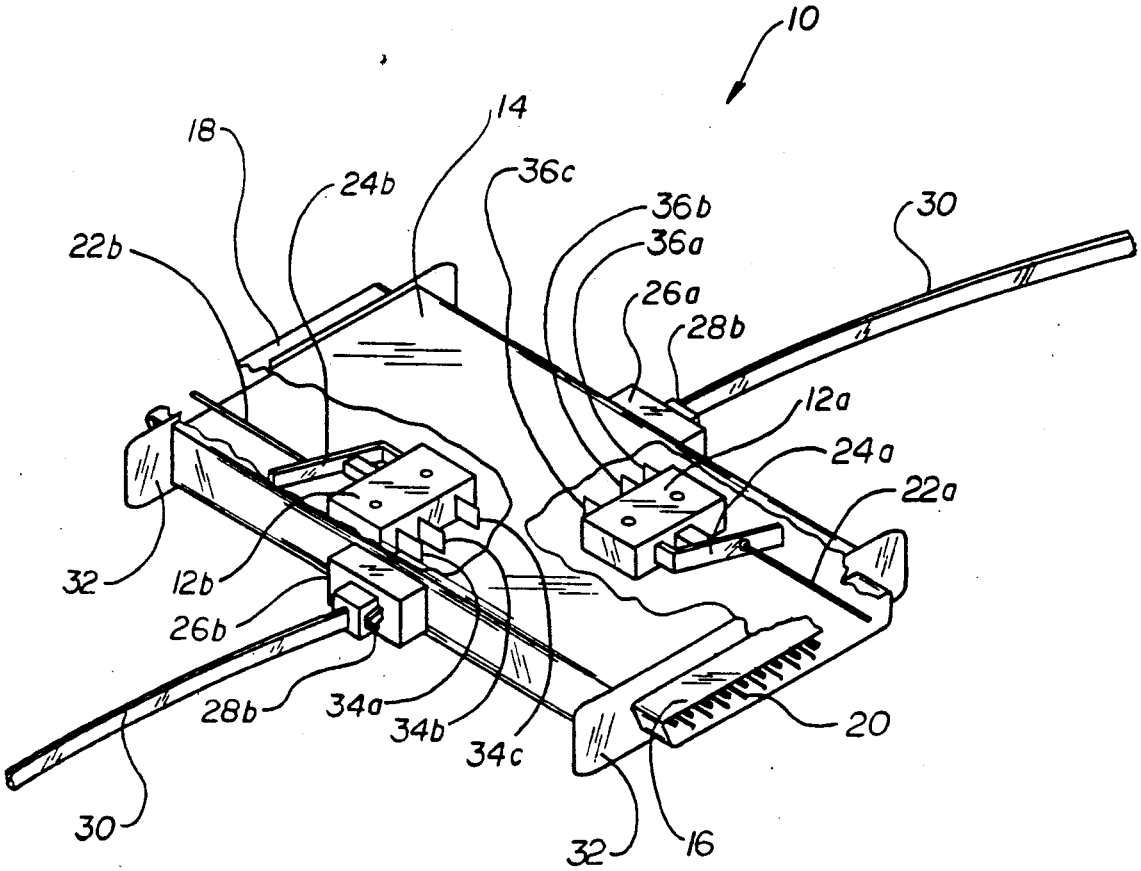
FIG. 1 is a perspective view of a preferred embodiment of the electronic component sensor showing a pair of micro-switches associated with opposing 25-pin DB-25 conventional connectors.
Figure 2:
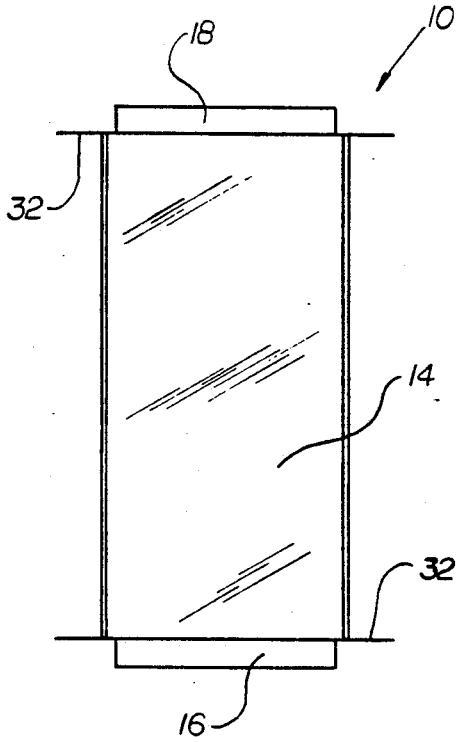
FIG. 2*a* is a top plan view of a preferred embodiment of the electronic component sensor showing the top portion of the opposing 25-Pin DB-25 connectors.
FIG. 2*b* is a top plan sectional view of a preferred embodiment of the electronic component sensor showing a micro-switch, switch arm, and non-conductive switch activation pin associated with each connector.
Figure 2:
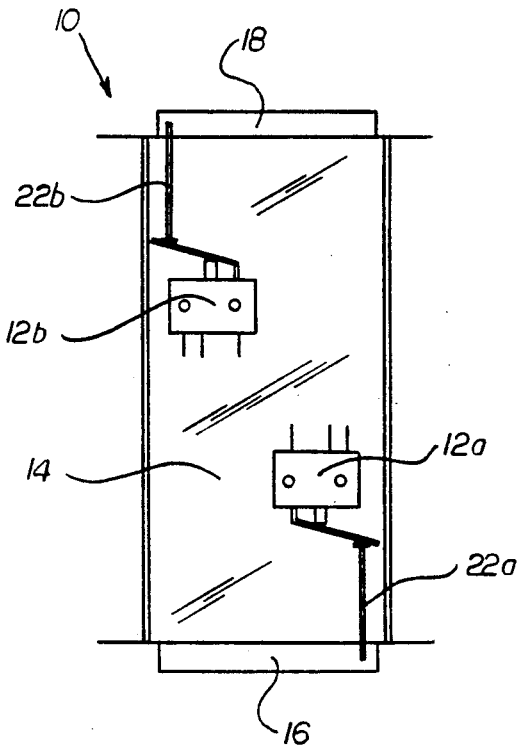
Figure 3:
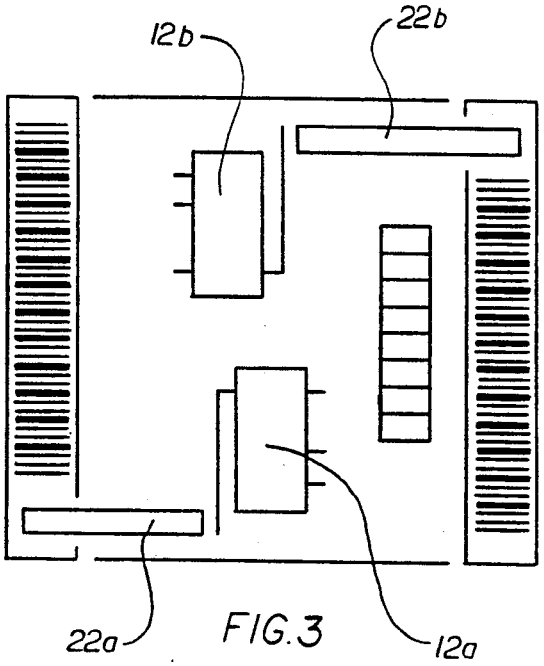
FIG. 3 is a diagrammatic illustration of a preferred embodiment of the electronic component sensor showing a micro-switch, switch arm, and non-conductive switch activation pin associated with each connector.

A preferred embodiment of the present invention 10 is shown in FIG. 1. The invention 10 includes a housing 14 adapted to secure conventional data connectors (16 and 18). Shown in FIG. 1 are two DB-25 connectors (also known as RS-232 connectors).

In a preferred embodiment one of the data connectors is female and one is male. Each data connector has 25 bus lines and the bus lines of each data connector are connected so that the data connectors may be used for data transmission.

Contained within the housing 14 is a micro-switch (12*a* and 12*b*) associated with each of the data connectors (16 and 18). Each micro-switch (12*a* and 12*b*) is mounted to the housing 14 behind the data connectors (16 and 18).

Each bus line or pin of a DB-25 connector is available for carrying digital information via an electrical current. In accordance with Electronic Industries Association (EIA) standards all but pins 18 and 25 are assigned a special purpose. For this reason it is possible to omit either or both of these pins without affecting the utility of the connectors (16 and 18) as data ports. In a preferred embodiment pin 25 is drilled from both connectors (16 and 18) to accommodate a micro-switch activation pin (22*a* and 22*b*). These pins (22*a* and 22*b*) abut the surface of their associate micro-switch activation plate (24*a* and 24*b*) and protrude into the connector (16 and 18) past the connector face plates 32.

In a preferred embodiment one of the connectors is a female connector 18 adapted to be removably connected to a male connector while the other connector is a male connector 16 adapted to be removably secured to a female connector. In this way a data bus or cable 46, such as a printer cable (FIG. 4), connected to a printer 44 or the like may be connected to one of the data connectors (16 or 18) while the other data connector (16 or 18) may be connected to the serial port of a computer 68.

With the connectors (16 and 18) of the sensor 10 sandwiched between a compatible computer data port connector and a compatible data cable connector the normally closed contacts of the micro-switches (12*a* and 12*b*) are opened and the normally open contacts are closed. Likewise, so long as a connector (16 or 18) of the sensor 10 is not connected to a compatible connector the normally closed contact of micro-switch (12*a* or 12*b*) is closed and the normally open contact is open.

Each micro-switch (12*a* or 12*b*) may also be maintained open while disconnected from a compatible connector. This is done by connecting a compatible dummy plug 48 to every connector (16 or 18) which will not be connected to a compatible connector.

In a preferred embodiment a pair of female RJ11 modular socket (26*a* and 26*b*) are connectively mounted on the side surfaces of the housing 14. The connectors of the plug are connected to the micro-switch terminals (34*a*, 34*b*, and 34*c* and 36*a*, 36*b*, and 36*c*) in accordance with either of the schematics illustrated by FIGS. 9 and 10.

Figure 4:
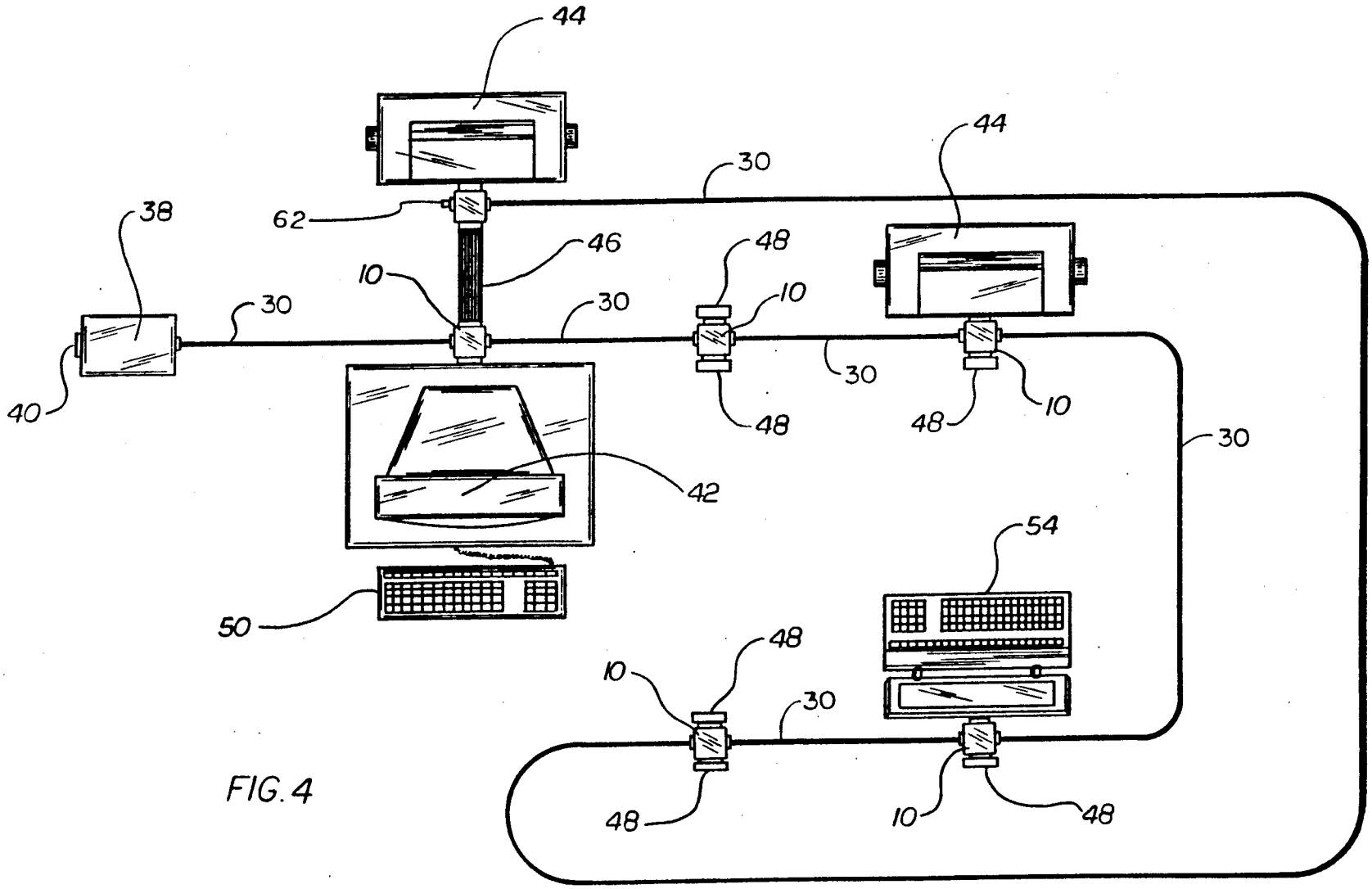
FIG. 4 is a top plan illustrative view of a preferred embodiment of the electronic component sensor and security system adapted for use with computer equipment.

A plurality of sensors 10 may be interconnected in series, via female RJ11 modular sockets (26*a* and 26*b*), with lengths of suitable four line cable 30 terminating with male RJ11 plugs 28*b* (FIG. 4). The last modular socket of the final sensor in the system (FIG. 4) must be shorted with an end terminal plug 62.

Figure 5:
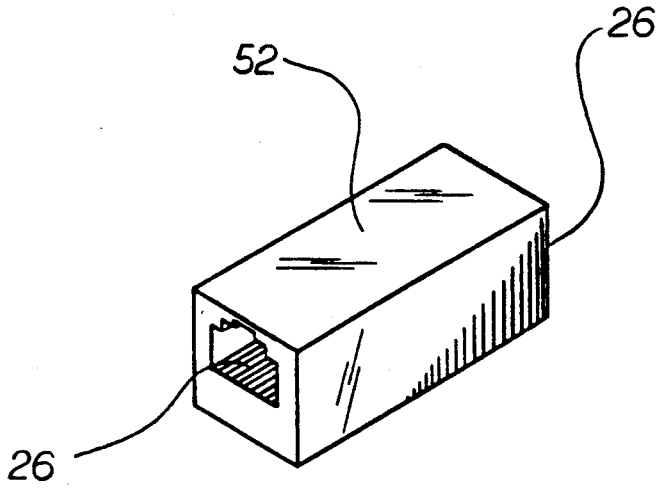
FIG. 5 is a perspective of an RJ-11 adapter for use in removing and substituting a protected electronic appliance sensor from the security system.

At the opposing end of the system the final length of cable 30 connected to the last sensor 10 in the series is plugged into an alarm 38. A spring loaded key switch 40 is also provided in series with the alarm voltage (B). When a computer or peripheral is to be extracted from a display of computers or the like the key switch 40 is held open until a feed through adapter 52 (FIG. 5) can be used to replace the sensor connected to the computer or peripheral being removed from the display or the like. Once the adapter 52 is in place the key switch 40 is returned by its spring action to an armed position.

Figure 9:
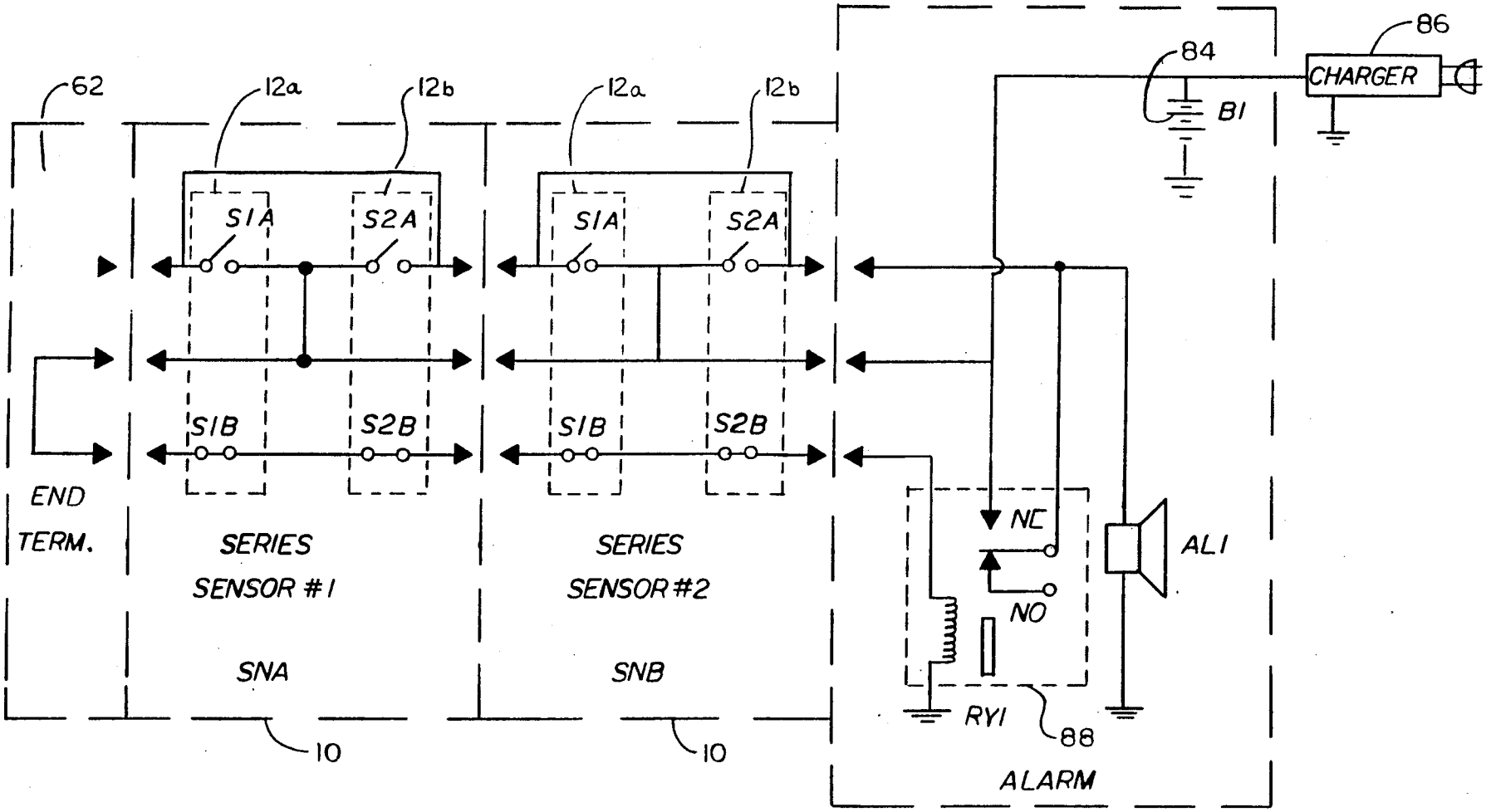
FIG. 9 is an electrical schematic for open and closed alarm circuitry.

In a preferred embodiment rechargeable batteries 84 are used to supply current to the alarm circuit. The charger 86 is connected to the batteries 84 at all times in order to maintain a full charge on the batteries 84 at all times (FIGS. 9 and 10).

Figure 10:
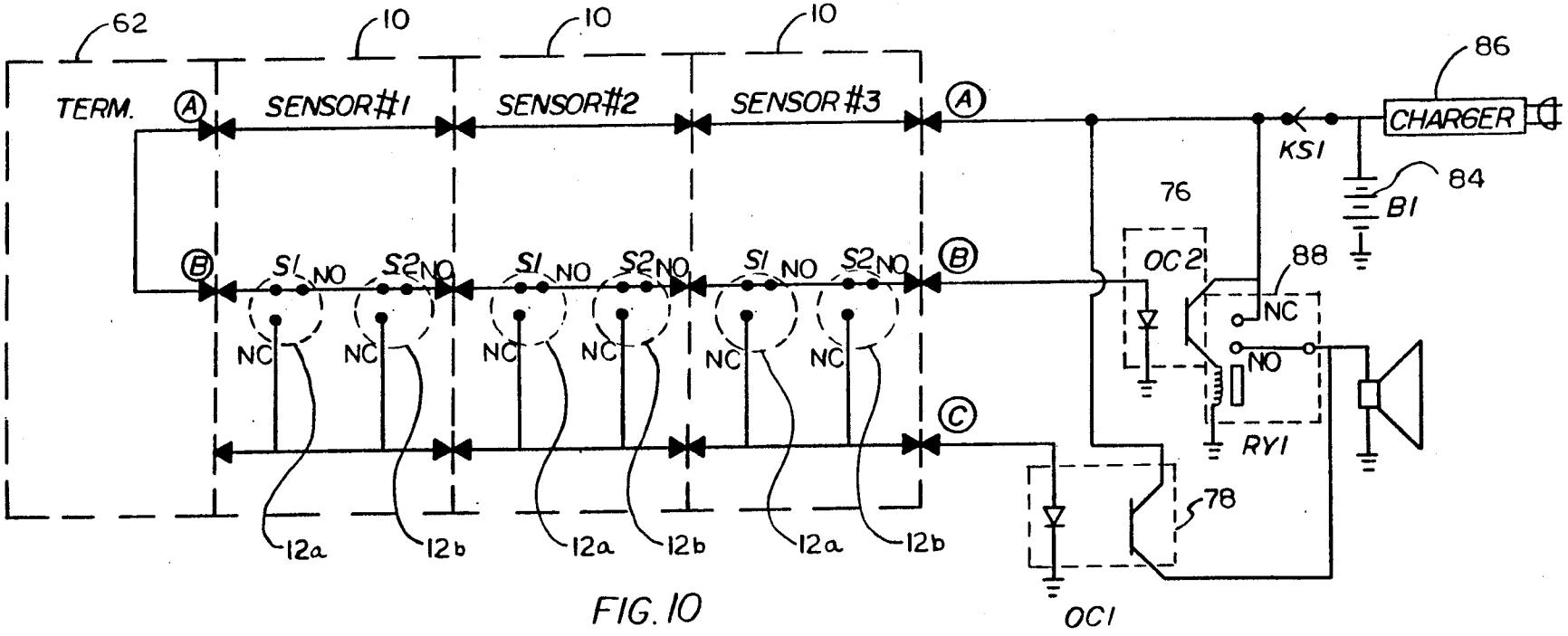
FIG. 10 is an electrical schematic for open and closed alarm circuitry wherein an optocoupler is utilized.

The alarm circuit has three lines (FIG. 10). One for the open circuit (C), one for the closed circuit (B), and a third which acts as a common current source (A) for open circuit (C) and closed circuit (B) (FIGS. 9 and 10). The common current source (A) feeds the closed circuit (B) contacts of both micro-switches (12*a* and 12*b*) via the terminator 62. This current holds the normally closed contacts of the alarm relay 88 open. If the closed circuit (B) is broken the relay's normally closed contacts close and supply current to sound the alarm. In the open circuit (C) the contacts are connected in parallel. If the normally closed contacts of the micro-switch (12*a* or 12*b*) are closed or the alarm wires shorted current is allowed to sound the alarm (FIGS. 9 and 10). In a preferred embodiment the invention is adapted to perform as a retail computer store security system. In FIG. 4 all computer components on display are provided with compatible sensors 10. For example, a sensor 10 is connected to each computer 42 and printer 44 on display. An alarm 38 housing containing alarm circuitry and a spring loaded key switch 40 may be mounted beneath the cash register counter. Each sensor 10 may then be connected in series to the alarm 38 via lengths of four wire telephone cable 30. Each end of each length of cable 30 terminates in a male RJ11 plug 28*b* (FIG. 1). Additionally, data bus or cable 46 such as a printer cable, may be connected between sensors 10 so as to allow normal operation of the computer peripherals without interference from the anti-theft apparatus (FIG. 4).

Figure 7:
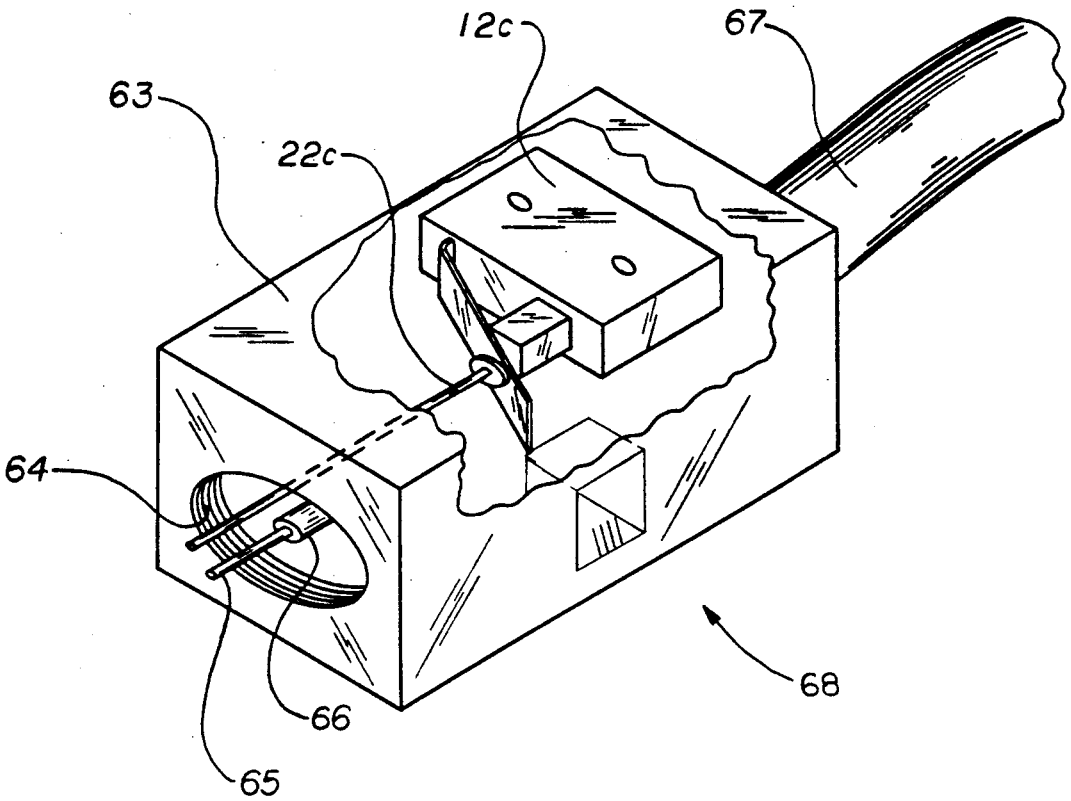
FIG. 7 is a perspective of a preferred embodiment of the electronic component sensor showing a micro-switch associated with a Cable Television Coaxial conventional connector.

In another embodiment of the invention 68 (FIG. 7) a housing 63 is provided containing a micro-switch 12*c*. The housing has one connector 64 adapted to be removably secured to the coaxial port of a standard television receiver, video player/recorder, or computer local area network. A cable 67 having outside insulation, a metallic shield connected to the connector threads, and an internal copper wire 65 protected from the metallic shield by insulation 66.

As described before, the micro-switch 12*c* is associated with an activation pin 22*c* whereby connection of the connector 64 to a compatible electronic device will cause the micro-switch 12*c* to be activated so long as the connection is maintained.

In FIG. 1, a pair of female RJ11 modular sockets (26*a* and 26*b*) are connectively mounted on the side surfaces of the housing 63. The connectors of the plug are connected to the micro-switch terminals in accordance with either of the schematics illustrated by FIGS. 9 and 10. In operation the coaxial sensors 68 may be connected in series or individually to an alarm 38. A hotel or motel might connect a sensor 68 to each of the television receivers located in its guest rooms. In this fashion theft of the receivers may be thwarted inexpensively.

Figure 8:
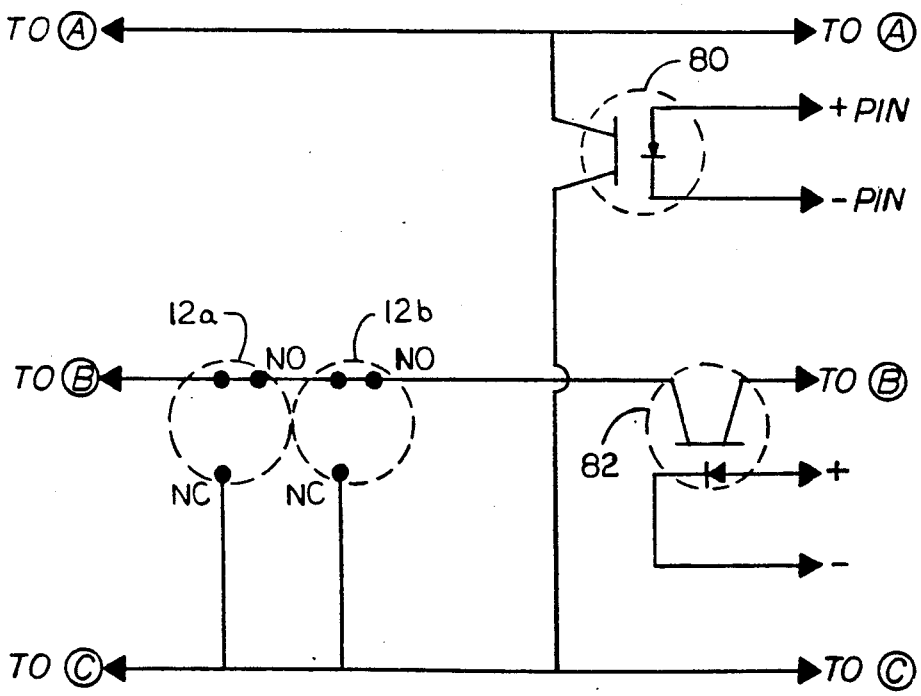

FIG. 8 illustrates a circuit which may be adapted for use with either of the circuits illustrated in FIGS. 9 or 10. Such a circuit utilizes an optocoupler to detect a change in potential difference across two pins of a standard connector, and could be used to determine if a piece of equipment, such as a computer, printer or the like, had been turned "off" or "on." In such a circuit, conventional optoisolators 80, 82 may be connected to the voltage pins in the data connector of the piece of equipment to be monitored. Upon a change in the power status of the equipment, the optoisolators will cause current to flow in the alarm circuit thereby causing the alarm to sound.

Figure 6:
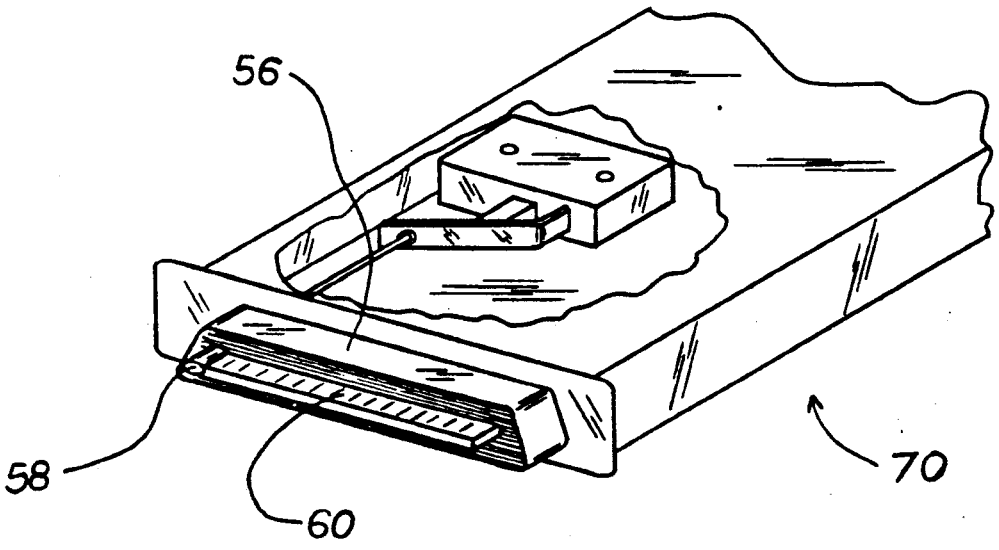
FIG. 6 is a front view of a preferred embodiment of the electronic component sensor showing a micro-switch associated with a 36-Line Centronics connector.

FIG. 6 illustrates another embodiment of the sensor 70 adapted for use as a Centronics connector. It will be apparent to those skilled in the art that the present invention may be adapted for use with any standard connector used in any electronic device.

While the invention has been described with a certain degree of particularity, it is manifest that many changes may be made in the details of construction and the arrangement of components without departing from the spirit and scope of the disclosure. It is understood that the invention is not limited to the embodiments set forth herein for purposes of exemplification, but is to be limited only by the scope of the appended claims including the full range of equivalency to which each element thereof is entitled. For example, the sensor and system disclosed by the present invention need not be limited to electrical devices alone. Mechanical devices which have connectors, such as hydraulic connectors and the like, may also be protected by an embodiment of the present invention by simply coupling a sensor adapted for such use between such mechanical connections.

Thus, there has been shown and described an improved electronic component theft sensor and security system which accomplishes at least all of the stated objects.

I claim:

1. An anti-theft apparatus adapted to prevent the theft of electronic devices having at least one compatible data connection port for use in combination with an electrically actuated alarm, said anti-theft apparatus comprising:

at least two conventional data connectors wherein at least one of said two conventional data connectors is adapted to be removably connected to the compatible data port of an electronic device;

a housing on which said at least two conventional data connectors are mounted;

switching means associated with each of said conventional data connectors of said housing;

conductor means for conducting current from said switching means to an electrically actuated alarm; and said switching means operative to open/close alarm circuitry when said conventional data connector is removably connected to a compatible data port of an electronic device and to close/open alarm circuitry when said conventional data connector is disconnected from a compatible data port of an electronic device thereby activating said alarm to signal a theft may be occurring.

2. The anti-theft apparatus of claim 1, wherein said conductor means is connected to said switching means such that said electrically actuated alarm signals a theft may be occurring if said connection means is disconnected.

3. The anti-theft apparatus of claim 2, wherein said conductor means comprises:

at least one alarm connector operatively connected to each of said switching means;

at least one compatible alarm connector adapted to removably engage said alarm connector; and at least one conductor operatively connected to at least one of a plurality of alarm connectors and an electrically actuated alarm.

4. The anti-theft apparatus of claim 1, further comprising detector means for determining whether the protected electrical component has been turned off if on and on if off.

5. The anti-theft apparatus of claim 4, wherein said detector means comprises an optocoupler for sensing a change in potential difference between data bus lines of a conventional data connector of a protected electronic component.

6. The anti-theft apparatus of claim 1, wherein said switching means is a micro-switch.

7. The anti-theft apparatus of claim 1, wherein said switching means comprises:

a micro-switch mounted on said housing and associated with each of said conventional data connectors: and a non-conductive switch activation pin associated with each of said micro-switches such that said pin is depressed causing said micro-switch to open while said conventional data connector is connected to a compatible data connector.

8. The anti-theft apparatus of claim 1, wherein said conventional data connectors are 25-Pin DB-25 connectors.

9. The anti-theft apparatus of claim 1, wherein said conventional data connectors are 36-Line Centronics connectors.

10. The anti-theft apparatus of claim 1, wherein said conventional data connectors are coaxial cable connectors.

11. The anti-theft apparatus of claim 1, wherein said conventional data connectors are RCA jacks.

12. An anti-theft apparatus adapted to prevent the theft of electronic devices having at least one data port said anti-theft apparatus comprising:

at least two connectors each adapted to be removably connected to the data port of an electronic device;

a housing on which said at least two connectors are mounted;

an alarm including, open and closed alarm circuitry, signal means, and means for connecting said open and closed alarm circuitry to an electric power source;

switching means associated with each of said connectors of said housing adapted to close said closed alarm circuitry and open said open alarm circuitry when said connector is removably connected to the data port of an electronic device and to open said closed alarm circuitry and close said open alarm circuitry when said connector is disconnected from the data port of an electronic device; and connection means for connecting said switching means to said alarm open and closed circuitry so that said closed alarm circuitry is closed so long as said connection means is unbroken and opened if said connection means is broken whereby said signal means of said alarm announces the closing of said open alarm circuitry and the opening of said closed alarm circuitry while said alarm is connected to an electric power source.

13. The invention of claim 12, wherein said connection means further comprises a plurality of lengths of electric cable such that multiple anti-theft apparatuses may be connected allowing multiple pieces of electronic equipment to be monitored simultaneously.

14. The anti-theft apparatus of claim 13, further comprising a data bus, said data bus connecting a plurality of pieces of said protected equipment and being operative to provide data communication therebetween thereby allowing normal operation of said equipment without interference from said anti-theft apparatus.

15. The anti-theft apparatus of claim 14, wherein both of said data port connectors are male connectors.

16. The anti-theft apparatus of claim 14, wherein both of said data port connectors are female connectors.

17. The anti-theft apparatus of claim 14, wherein one of said data port connectors is a male connector and the other of said data port connectors is a female connector.

18. A computer component anti-theft sensor for use in combination with an alarm having open and closed circuitry, signal means, means for connecting said open and closed alarm circuitry to an electric power source, and an alarm connection cable, said anti-theft sensor comprising:

a housing;

a pair of interconnected conventional data connectors connectably housed within said housing;

a micro-switch associated with each of said data connectors and housed within said housing;

means for connecting said micro-switches to an alarm; and a non-conductive micro-switch activation pin protruding from each of said associated data connectors and abutting against each of said micro-switches whereby connecting said data connector to a compatible data connector causes said micro-switch activation pin to be depressed thereby closing said micro-switch and arming said alarm and whereby unplugging said conventional data connector from said compatible data connector causes said micro-switch to open causing said alarm to activate thereby causing said alarm signaling means to signal a theft may be occurring.

19. The computer component anti-theft sensor of claim 18, wherein said means for connecting said micro-switches to an alarm comprises at least one alarm connector associated with said housing and adapted to removably receive a compatible alarm connector connected via an alarm connection cable to alarm circuitry whereby cutting or disconnecting or shorting said alarm connection cable causes said alarm to signal a theft.

20. The computer component anti-theft sensor of claim 18, wherein said sensor further comprises deactivation-activation sensor means whereby said alarm signals whenever a computer component left on has been turned off and whenever a computer component left off has been turned on.

21. A computer component anti-theft security system, for use in combination with an alarm having open and closed circuitry, signal means, means for connecting said open and closed alarm circuitry to an electric power source, and an alarm connection cable, said anti-theft security system comprising:

at least two sensors wherein each sensor includes, a housing, a pair of interconnected conventional data connectors connectably housed within said housing, a micro-switch associated with each of said data connectors and housed within said housing, means for connecting said micro-switches to an alarm wherein said means for connecting said micro-switches to an alarm includes at least one alarm connector associated with said housing and adapted to removably receive a compatible alarm connector connected via an alarm connection cable to alarm circuitry whereby cutting or disconnecting or shorting said alarm connection cable causes said alarm to signal a theft, and a micro-switch activation pin protruding from each of said associated data connectors and abutting against each of said micro-switches whereby connecting said data connector to a compatible data connector causes said micro-switch activation pin to be depressed thereby closing said micro-switch and arming said open alarm and whereby unplugging said conventional data connector from said compatible data connector causes said micro-switch to open causing said open alarm to close and said closed alarm to open and thereby causing said alarm signaling means to signal a theft may be occurring.

* * * * *